US005727822A

United States Patent [19]

Truong

[11] Patent Number: 5,727,822

[45] Date of Patent: Mar. 17, 1998

[54] ADVANCED DOOR SECURITY LOCK

[75] Inventor: David Truong, San Jose, Calif.

[73] Assignee: International Business & Technology Corporation, San Jose, Calif.

[21] Appl. No.: 608,518

[22] Filed: Feb. 28, 1996

[51] Int. Cl.[6] ..... E05C 3/04

[52] U.S. Cl. ..... 292/202; 292/1; 292/DIG. 15; 16/82

[58] Field of Search ..... 292/288, 297, 292/1, 238, DIG. 15, 194, 202; 16/82

[56] References Cited

U.S. PATENT DOCUMENTS

| | | | |
|---|---|---|---|
| 1,082,432 | 12/1913 | Mertsheimer | 292/DIG. 15 X |
| 5,383,254 | 1/1995 | Wigley, Sr. | 292/DIG. 15 X |
| 5,490,304 | 2/1996 | Winner, Jr. et al. | 292/DIG. 15 X |

*Primary Examiner*—Rodney M. Lindsey

*Attorney, Agent, or Firm*—Hickman Beyer & Weaver

[57] ABSTRACT

The present invention relates, in one embodiment, to an apparatus for holding a door. The apparatus includes a body member and a blocking member rotatably coupled to the body member. The coupling is such that when the body member is positioned vertically in front of the door, the blocking member is disposed in one of a first blocking position and a second blocking position. The blocking member, in the first blocking position, contacts the door to hold the door at a first predefined position. The apparatus, when the blocking member is in the second blocking position, contacts the door to hold the door at a second predefined position. The door is opened further in the second predefined position than in the first predefined position.

24 Claims, 5 Drawing Sheets

ADVANCED DOOR SECURITY LOCK

BACKGROUND OF THE INVENTION

The present invention relates to a methods and apparatus for use in home and office security. More particularly methods and apparatus for securely keeping a door from being forcibly broken down, both while it is closed and while it is partially open, are disclosed.

Crime rates, particularly rates pertaining to home-invasion crimes, are on the rise. As such, the issue of home security is of considerable concern to many people. Since a substantial percentage of home-invasion crimes begins with the act of a door being broken down, specialized door security devices have been developed to prevent doors from being broken down from the outside.

Although existing door security devices in the market today have been shown to be effective in preventing doors from being broken down from the outside when the door is completely closed, these existing devices are not particularly effective at securing the door in its partially open state, e.g., when the occupant desires to open the door partially to identify the caller, to receive mail or packages, to allow in pets, or the like.

In view of the foregoing, what is desired is improved methods and apparatus for securely keeping a door from being forcibly broken down, both in its closed state and in its partially open state.

SUMMARY OF THE INVENTION

The present invention relates, in one embodiment, to an apparatus for holding a door. The apparatus includes a body member and a blocking member rotatably coupled to the body member. The coupling is such that when the body member is positioned vertically in front of the door, the blocking member is disposed in one of a first blocking position and a second blocking position. The blocking member, in the first blocking position, contacts the door to hold the door at a first predefined position. The apparatus, when the blocking member is in the second blocking position, contacts the door to hold the door at a second predefined position. The door is opened further in the second predefined position than in the first predefined position.

In another embodiment, the invention relates to a method for blocking a door from being forcibly opened from either a fast predefined position or a second predefined position. The method includes the steps of providing a body member and rotatably coupling a blocking member to the body member. The coupling is such that when the body member is position in front of the door, the blocking member is disposed in one of a first blocking position and a second blocking position. The blocking member, when disposed in the first blocking position, contacts and prevents the door from being further moved in a direction toward the body member from the first predefined position. The door, when the blocking member is disposed in the second blocking position, is prevented from being further moved in the direction toward the body member from the second predefined position.

These and other advantages of the present invention will become apparent upon reading the following detailed descriptions and studying the various figures of the drawings.

BRIEF DESCRIPTION OF THE DRAWINGS

The invention may best be understood by reference to the following description taken in conjunction with the accompanying drawings in which.

DETAILED DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be obvious, however, to one skilled in the art, that the present invention may be practiced without some or all of these specific details. In other instances, well known structures and process steps have not been described in detail in order not to unnecessarily obscure the present invention.

Figure 1:
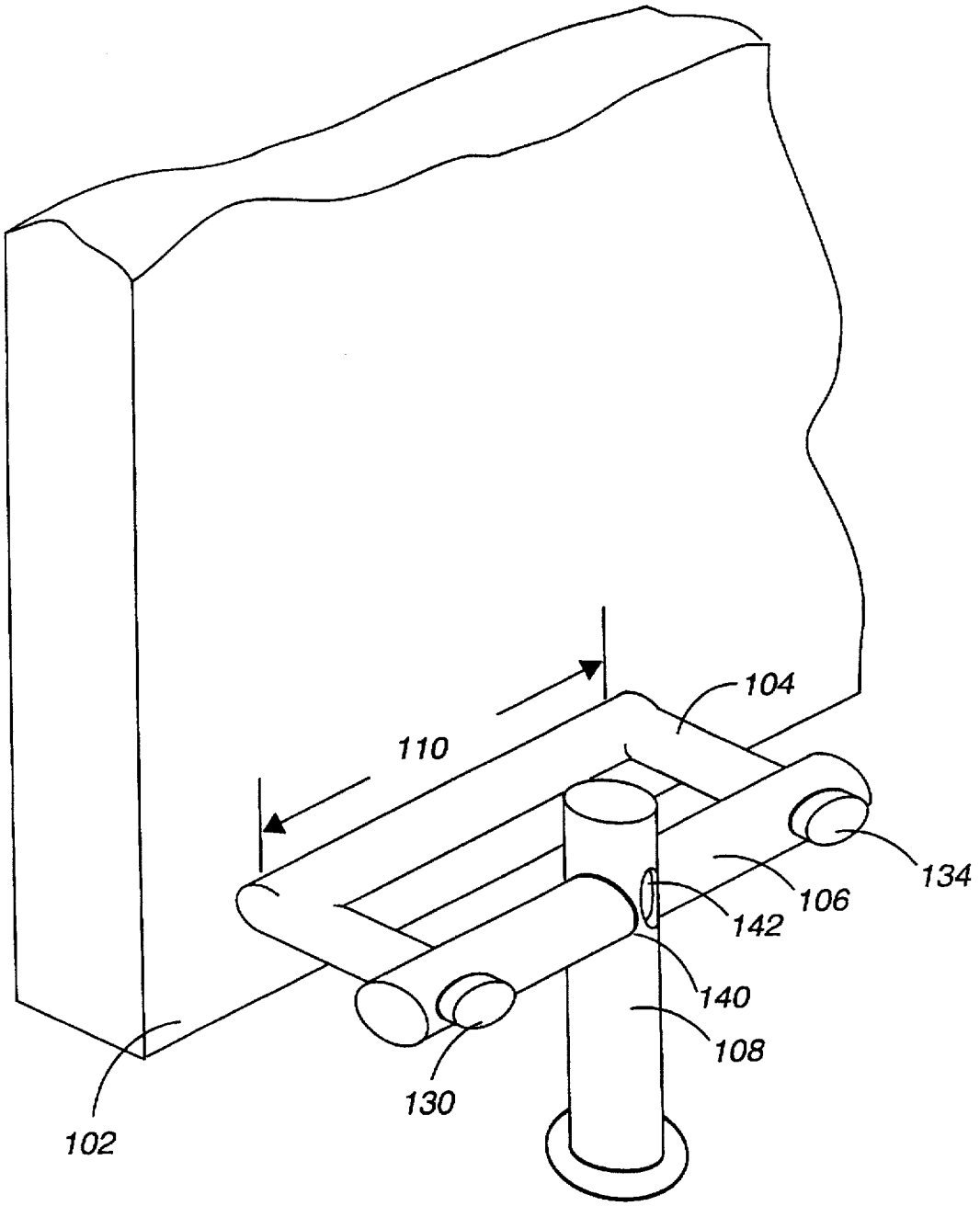
FIG. 1 is an illustration of an Advanced Door Security lock in accordance with a preferred embodiment of the present invention.

Referring initially to FIG. 1, there is shown an Advanced Door Security (ADS) lock in accordance with a preferred embodiment of the present invention. The ADS lock comprises a lock-arm 104, a bar 106, and a body member 108. Lock-arm 104 is mechanically coupled to bar 106, and the combination of lock-arm 104 and bar 106 forms what will herein be referred to as a blocking member. The blocking member is rotatably coupled to body member 108. In this embodiment, the blocking member is comprised of lock-arm 104 and bar 106, which are formed as individual pieces. However, in general, the blocking member may be made up of only one piece, i.e., lock-arm 104 and bar 106 may be formed as a single part.

In order for the ADS lock to secure a door, the ADS lock must is mounted to a floor, or a similar surface, at the foot of a door such that when an attempt is made at opening the door, the door contacts the ADS lock. In some cases, the ADS lock may be mounted directly into the floor. In others, body member 108 may be mounted in a receptacle (not shown) which may be attached to the floor using mechanical screws or an adhesive. The receptacle may also include holes or a sleeve to physically support body member 108.

In this embodiment, body member 108 is mounted vertically in front of a door 102 it is intended to secure. The location of body member 108 is such that when the blocking member of the ADS lock is in a first blocking position, lock-arm 104 makes contact with door 102 to hold it in a first predefined position as shown in FIG. 1. Typically, when door 102 is closed, it is considered to be in the first predefined position although this first predefined position may also represent a slightly open door. The portion of lock-arm 104 which contacts door 102 when the blocking member is in a first blocking position is heroin referred to as a blocking edge 110. When body member 108 is positioned in front of door 102, blocking edge 110 is positioned in the first blocking position such that blocking edge 110 comes into contract with door 102 to hold it in the first predefined position. More preferably, blocking edge 110 is in a horizontal position, i.e., it is parallel to the plane of the floor.

The blocking member is rotatably coupled to body member 108 by means of a thru-hole 140 in body member 108 in which bar 106 of the blocking member is placed. Thru-hole 140 should be large enough to accommodate bar 106 and provide enough clearance to allow bar 106 to rotate in thru-hole 140 about its center-line. As bar 106 rotates, due to the fact that lock-arm 104 is mechanically coupled to bar 106, lock-arm 104 and blocking edge 110 also rotate with respect to the center-line of bar 106.

The rotation of bar 106 is preferably mechanically constrained, i.e., bar 106 is free to rotate only within a fixed range. A pin (shown in greater detail in subsequent FIGS. 2 and 3) is inserted into bar 106 through a thru-slot 142 in body member 108. The pin rotates within thru-slot 142 and serves to constrain the rotation of bar 106. Rotation is constrained when the pin reaches the bottom of thru-slot 142, thereby holding the blocking member at either the first blocking position or the second blocking position.

In one embodiment, when the blocking member is in the second blocking position, ends 130 and 134 of lock-arm 104 make contact with door 102 to hold it at a second predefined position. In some cases, depending upon the dimensions of body member 108, body member 108 may come into contact with door 102 to furnish a third point of contact to more securely hold door 102 in the second predefined position.

The second blocking position of the blocking member holds door 102 in the second predefined position, which is generally a position in which door 102 is opened wider than it is when it is in a first predefined position. By way of example, in some embodiments, the first predefined position will be when door 102 is closed, and the second predefined position will be when door 102 is open approximately 2.5 inches. In others, the blocking member is preferably dimensioned such that second predefined position is reached when door 102 is open approximately 3 feet, e.g., enough to allow a single person to enter as in crowd control applications. In general, the second blocking position may be reached by rotating the body member away from the first blocking position. More preferably, the blocking member is placed at the second blocking position by rotating it 180 degrees from the first blocking position, e.g., by flip it around the axis of bar 106.

Alternatively, it is contemplated that the blocking member, when in the first blocking position, is disposed such that its plane is substantially parallel to the ground and points toward the door, i.e., its blocking edge is closer to the door than the bar. In the second blocking position, the blocking member may be mechanically constrained at a slight angle, preferably pointing toward the door, to permit the door to be slightly open. The angle may be either upward or downward. Further, it is contemplated that mechanical devices, e.g., a spring, may be provided to help the blocking member to return to the first blocking position from the second blocking position.

Figure 2:
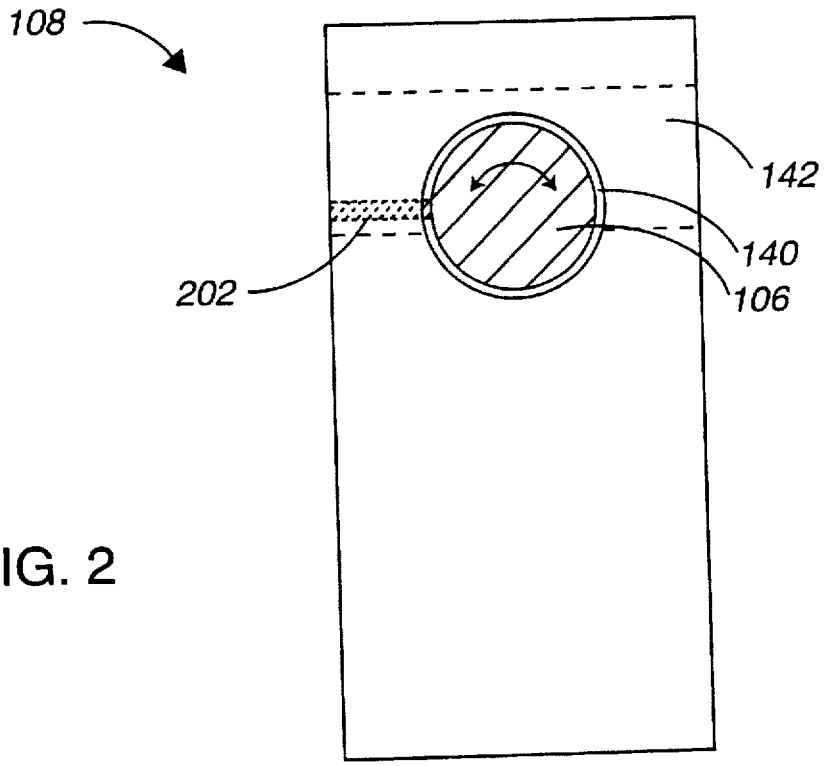
FIG. 2 is a cross-sectional illustration of a first configuration of the body member of an Advanced Door Security lock in accordance with a preferred embodiment of the present invention.

Referring next to FIG. 2, a cross-sectional illustration of a configuration of aforementioned body member 108 will be described in detail. As previously mentioned with respect to FIG. 1, thru-hole 140 in body member 108 serves to hold bar 106 while enabling the bar to rotate about its center-line. Bar 106 contains a pin 202 which rotates in thru-slot 142 with bar 106 (and constrained when pin 202 reaches the bottom of thru-slot 142. In this configuration, bar 106 and the lock-arm, e.g. bar 106 and lock arm 104 of FIG. 1, which comprise the blocking member as previously described must be made of more than one piece to enable bar 106 to be inserted through the thru-hole 140.

Figure 3:
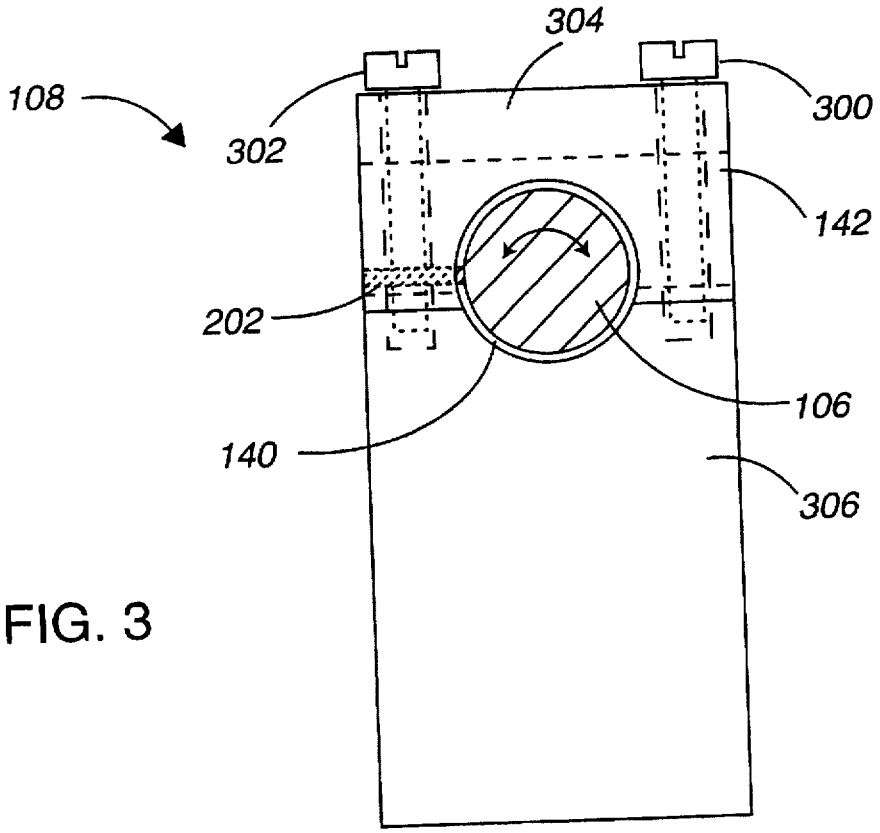
FIG. 3 is a cross-sectional illustration of a second configuration of the body member of an Advanced Door Security lock in accordance with a preferred embodiment of the present invention.

FIG. 3 is a cross-sectional illustration of another configuration of body member 108. In this configuration, body member 108 is comprised of two pieces, a body stem 306 and a body cap 304, which are held together with fasteners 300 and 302. Fasteners 300 and 302 may represent, for example, screws or the like. Pin 202 and thru-slot 142 are again shown. As described with respect to FIG. 2, thru-hole 140 in body member 108 serves to hold bar 106 which, in turn, contains pin 202. As previously mentioned, pin 202 rotates in thru-slot 142 while bar 106 rotates about its center-line. In this configuration, the lock-arm, as for example lock-arm 104 as described with reference to FIG. 1, and bar 106 are not required to be constructed of more than one piece. The fact that body member 108 is comprised of body stem 306 and body cap 304 makes it possible for a one-piece blocking member to be placed in thru-hole 140.

Figure 4:
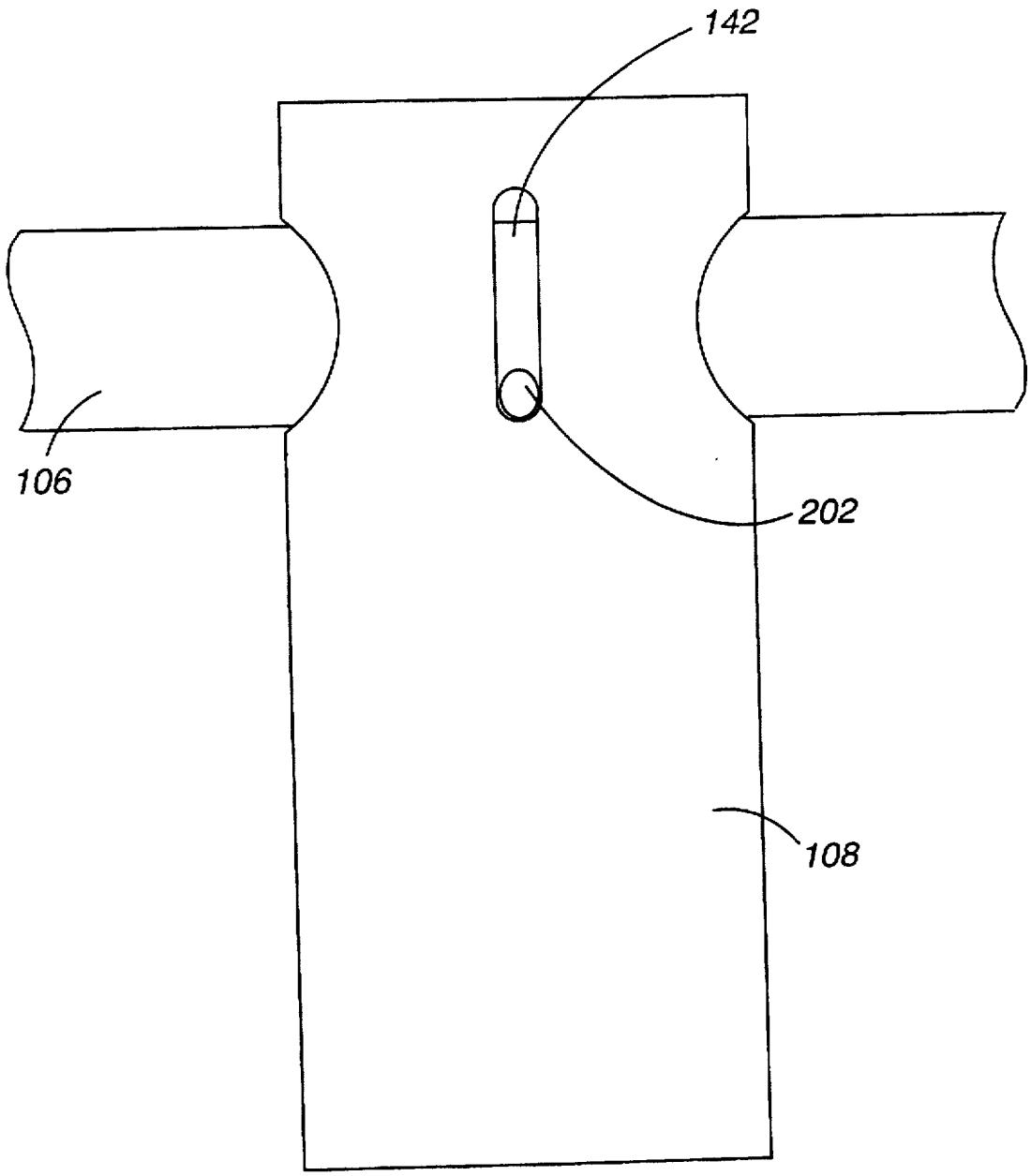
FIG. 4 is an illustration of the body member of an Advanced Door Security lock shown with the mechanism which constrains the rotation of the bar and the blocking member of the Advanced Door Security lock in accordance with a preferred embodiment of the present invention.

Referring next to FIG. 4, the mechanism which serves to constrain rotation of bar 106 (and concomitantly of the blocking member) will be explained in detail. FIG. 4 is an illustration of body member 108, which is shown as being of a one-piece construction, although it may also be comprised of two pieces as described above with reference to FIG. 3. Bar 106 contains pin 202 which rotates in thru-slot 142 and serves to constrain the rotation of bar 106 as it rotates about its center-line. When pin 202 comes to rest at the bottom of thru-slot 142, as shown, bar 106 is constrained from rotating any further in the direction it was rotating when pin 202 came to a rest. It should be clear that thru slot 142 extends through the bar; as such, pin 202 may come to rest in two positions, the position as shown in FIG. 4, and a position on the other side of body member 108.

Figure 5:
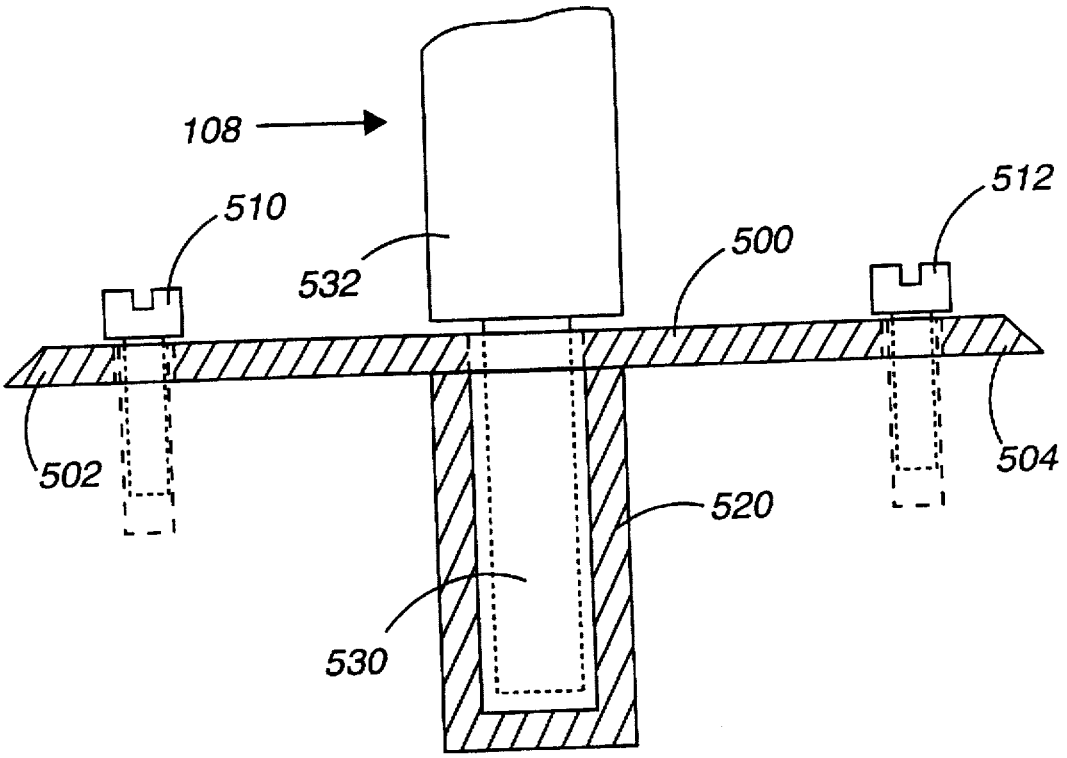
FIG. 5 is a cross-sectional illustration of a receptacle which is used to support an Advanced Door Security lock in accordance with a preferred embodiment of the present invention.

FIG. 5 is a cross-sectional illustration of a receptacle which may be used to support body member 108 of the ADS lock to more securely hold the ADS lock to the floor. Body member 108, as shown in FIG. 5, is a rod comprised of sections 532 and 530 which may have different diameters. The receptacle is comprised of a plate 500 which is mounted on a floor or similar surface to support body member 108. Plate 500 has a portion 520, e.g., a sleeve or a closed-end tube, which may be embedded into an opening in the floor and serves to more securely hold section 530 of body member 108. Alternatively, portion 520 may be integral with the plate, i.e., the sleeve or the closed-end tube is self-contained within the plate, so no alteration or drilling of the floor is necessary. This embodiment is highly advantageous in situations where it is not possible or desirable to create a hole in the floor to accommodate a portion 520 that is in the floor. To further reduce the alteration to the floor, the plate may be attached to the floor using, for example, an appropriate adhesive. Plate 500 may also have tapered edges 502 and 504, which serve to create a smooth transition between the boundary of plate 500 and the floor. Either an adhesive or fasteners 510 and 512, e.g., screws or the like, may be used to secure plate 500 to the floor.

Figure 6:
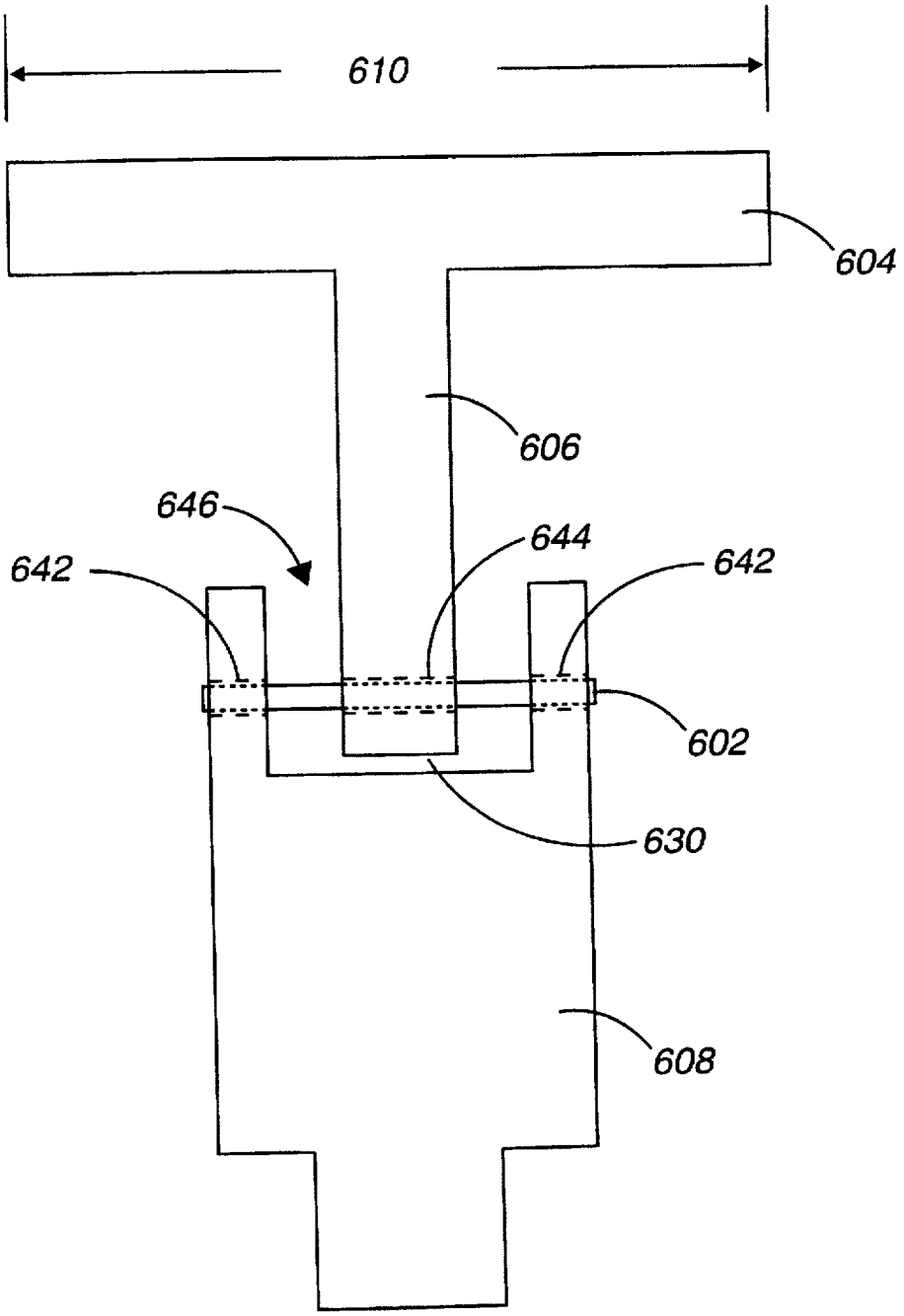
FIG. 6 is a cross-sectional illustration of an Advanced Door Security lock in accordance with another preferred embodiment of the present invention.

Referring next to FIG. 6, there is shown a cross-sectional illustration of an ADS lock in accordance with another preferred embodiment of the present invention. The ADS lock of this embodiment comprises a lock-arm 604, a bar 606, and a body member 608. Lock-arm 604 is analogous in function to lock-arm 104 of the previous embodiment. Similarly, bar 606 and body member 608 are analogous in function to bar 106 and body member 108, respectively, as shown in FIG. 1. As before, the combination of lock-arm 104 and bar 106 comprises a blocking member. The blocking member as shown in FIG. 6 is shaped like the letter "T." The blocking member is rotatably coupled to body member 608. In this embodiment, the blocking member is comprised of one piece, although lock-arm 604 and bar 606 may be separate elements which are mechanically coupled. A blocking edge 610, analogous in function to blocking edge 110, comes into contact with a door to hold it in a first predefined position.

To hold the door in a second predefined position, the blocking member is preferably rotated such that an end 630 of bar 606 contacts the door. End 630 is analogous in function to ends 130 and 134 as described with reference to FIG. 1, contacts the door. A pin 602 passes through a thru-slot 642 which extends through body member 608 to hold the blocking member while enabling it to rotate. The arch through which the blocking member may rotate is constrained by a notch 646 in the body member 608. When bar 606 contacts the bottom of notch 646 in body member 608, the blocking member is stopped from rotating any further in the direction in which it was rotating when contact was made.

Although only a few embodiments of the present invention have been described, it should be understood that the present invention may be embodied in many other specific forms without departing from the spirit or scope of the invention. In particular, although only two configurations of the blocking member have been disclosed, it should be clear that many other configurations may be embodied without departing from the spirit or the scope of the invention. Some possible configurations include, but are not limited to, configurations in which the blocking member is Y-shaped and configurations in which the blocking member is simply a single bar, e.g., without lock arm 604, or a plate.

In some embodiments of the present invention, it may be desirable to incorporate the use of roller bearings with the blocking member to extend the life of the ADS lock. Similarly, the use of a bearing surface, as for example a coating of Teflon™, may be implemented in place of an actual mechanical bearing. Therefore, the present examples are to be considered as illustrative and not restrictive, and the invention is not to be limited to the details given herein, but may be modified within the scope of the appended claims.

I claim:

1. An apparatus for holding a door, comprising:

a body member; and a substantially planar blocking member rotatably coupled to said body member such that when said body member is positioned vertically in front of said door, said blocking member is disposed in one of a first blocking position and a second blocking position, wherein said blocking member, in said first blocking position, contacts said door to hold said door at a first predefined position, said door being closed when held at said first predefined position, said apparatus, when said blocking member is in said second blocking position, contacts said door to hold said door at a second predefined position, and wherein said door is opened further in said second predefined position than in said first predefined position, wherein said blocking member lies in a first plane and said apparatus is symmetric about a second plane containing said first plane of said blocking member and said body member, thereby allowing said apparatus to hold said door at said first predefined position and said second predefined position respectively, irrespective of an orientation of said apparatus when so positioned.

2. The apparatus of claim 1 wherein said blocking member comprises a lock arm having a blocking edge, said blocking edge contacting said door when said blocking member is disposed in said first blocking position to hold said door at said first predefined position, said blocking edge, when said blocking member is disposed in said second blocking position, does not contact said door when said door is held at said second predefined position.

3. The apparatus of claim 2 wherein said blocking member further comprises a bar coupled to said lock-arm, wherein said door is held at said second predefined position by at least two contact points, two of said at least two contact points representing ends of said lock-arm.

4. The apparatus of claim 3 wherein a third contact point of said at least two contact points represents a contact point on said body member.

5. The apparatus of claim 1 wherein said second blocking position is achieved by rotating said blocking member about 180 degrees from said first blocking position.

6. The apparatus of claim 5 wherein said body member is arranged to be disposed in a hole in a floor, wherein a plane formed by said blocking member is substantially perpendicular to said body member when said blocking member is disposed in said first blocking position.

7. The apparatus of claim 1 wherein said blocking member comprises a lock arm and a bar coupled to said lock arm in a T configuration to permit said lock arm to contact said door when said blocking member is disposed in said first blocking position to hold said door at said first predefined position.

8. The apparatus of claim 7 wherein said second blocking position is achieved by rotating said blocking member about 180 degrees from said first blocking position.

9. The apparatus of claim 1 wherein said blocking member is substantially parallel to a horizontal plane and is disposed toward said door when said blocking edge is disposed in said first blocking position.

10. A method for blocking a door from being forcibly opened from either a first predefined position or a second predefined position, comprising:

providing a body member;

rotatably coupling a substantially planar blocking member to said body member such that when said body member is positioned in front of said door, said blocking member is disposed in one of a first blocking position and a second blocking position, wherein said blocking member, when disposed in said first blocking position, contacts and prevents said door from being further moved in a direction toward said body member from said first predefined position, said door being closed when held at said first predefined position, said door, when said blocking member is disposed in said second blocking position, is prevented from being further moved in said direction toward said body member from said second predefined position, wherein said blocking member is symmetric about said body member, thereby allowing said blocking member to hold said door at said first predefined position and said second predefined position respectively, irrespective of an orientation of said blocking member when so positioned; and further pivoting said blocking member from said second blocking position to said first blocking position in a first orientation of said body member, and pivoting said blocking member from said second blocking position to said first blocking position in a second orientation of said body member 180 degrees from the first orientation of said body member.

11. The method of claim 10 wherein said body member is in contact with said door when said blocking member is disposed in said second blocking position and said door is positioned at said second predefined position.

12. The method of claim 11 wherein said blocking member also contacts said door when said blocking member is disposed in said second blocking position and said door is positioned at said second predefined position.

13. The method of claim 10 wherein said body member is rotatable from said first blocking position to said second blocking position without moving said body member.

14. The method of claim 13 wherein said blocking member comprises a lock arm and a bar coupled to said lock arm.

15. The method of claim 14 wherein said lock arm and said bar is coupled in a T configuration.

16. An apparatus for blocking a door from being forcibly opened from either a first predefined position or a second predefined position, said door being opened further in said second predefined position than in said first predefined position, said apparatus comprising:

a body member; and a substantially planar blocking member rotatably coupled to said body member such that when said body member is positioned in front of said door, said blocking member is disposed in one of a first blocking position and a second blocking position, said blocking member, when disposed in said first blocking position, contacts and prevents said door from being further moved in a direction toward said body member from said first predefined position, said door being closed when held at said first predefined position, said door, when said blocking member is disposed in said second blocking position, is prevented from being further moved in said direction toward said body member from said second predefined position by said apparatus, and wherein said blocking member is rotatable from said first blocking position to said second blocking position without moving said body member, wherein said blocking member lies in a first plane and said apparatus is symmetric about a second plane containing said first plane of said blocking member and said body member, thereby allowing said apparatus to hold said door at said first predefined position and said second predefined position respectively, irrespective of an orientation of said apparatus when so positioned.

17. The apparatus of claim 16 wherein said body member is in contact with said door when said blocking member is disposed in said second blocking position and said door is positioned at said second predefined position.

18. The apparatus of claim 17 wherein said blocking member also contacts said door when said blocking member is disposed in said second blocking position and said door is positioned at said second predefined position.

19. The apparatus of claim 16 wherein said blocking member comprises a U-shaped lock arm and a bar coupled to said lock arm.

20. The apparatus of claim 16 wherein said blocking member comprises a lock arm and a bar coupled to said lock arm in a T configuration to permit said lock arm to contact said door when said blocking member is disposed in said first blocking position to prevent said door from being moved in a direction toward said body member from said first predefined position.

21. An apparatus for blocking a door from being forcibly opened from either a first predefined position or a second predefined position, said door being opened further in said second predefined position than in said first predefined position, said apparatus comprising:

a body member, said body member having a hole therethrough and a slot therethrough;

a substantially planar blocking member including a lock arm coupled to a bar, said blocking member being rotatably inserted through said hole of said body member such that when said body member is positioned in front of said door, said blocking member is disposed in one of a first blocking position and a second blocking position, said blocking member, when disposed in said first blocking position, contacts and prevents said door from being further moved in a direction toward said body member from said first predefined position, said door being closed when held at said first predefined position, said door, when said blocking member is disposed in said second blocking position, is prevented from being further moved in said direction toward said body member from said second predefined position by said apparatus, and wherein said blocking member is rotatable from said first blocking position to said second blocking position without moving said body member, wherein said apparatus is symmetric about said body member, thereby allowing said apparatus to hold said door at said first predefined position and said second predefined position respectively, irrespective of an orientation of said apparatus when so positioned; and a pin coupled to said blocking member, said pin being arranged to rotate within said slot of said body member to constrain rotation of said blocking member at its extremities to said first blocking position and said second blocking position.

22. The apparatus of claim 21 wherein:

said bar has a first opening and a second opening therethrough, wherein said lock arm is U-shaped, said lock arm having a first end and a second end, wherein said first end of said lock arm extends through said first opening of said bar and said second end of said lock arm extends through said second opening of said bar.

23. The apparatus of claim 22 wherein said body member is in contact with said door when said blocking member is disposed in said second blocking position and said door is positioned at said second predefined position.

24. The apparatus of claim 23 wherein said first end of said lock arm and said second end of said lock arm also contact said door when said blocking member is disposed in said second blocking position and said door is positioned at said second predefined position, thereby allowing said body member, said first end, and said second end to contact said door.

* * * * *